US007815186B2

(12) United States Patent
Lan et al.

(10) Patent No.: US 7,815,186 B2
(45) Date of Patent: Oct. 19, 2010

(54) CARTRIDGE

(75) Inventors: Ching-Long Lan, Houlong Township, Miaoli County (TW); Yu-Feng Huang, Chiayi (TW)

(73) Assignee: Lite-On Technology Corp., Taipei (TW)

( * ) Notice: Subject to any disclaimer, the term of this patent is extended or adjusted under 35 U.S.C. 154(b) by 378 days.

(21) Appl. No.: 11/987,027

(22) Filed: Nov. 27, 2007

(65) Prior Publication Data

US 2008/0168481 A1 Jul. 10, 2008

(30) Foreign Application Priority Data

Jan. 8, 2007 (TW) ..... 96200320 U

(51) Int. Cl.
*B65H 1/22* (2006.01)

(52) U.S. Cl. ..... 271/162

(58) Field of Classification Search ..... 271/162, 271/163, 164; 312/333; 292/219, 228, 121, 292/122, 128
See application file for complete search history.

(56) References Cited

U.S. PATENT DOCUMENTS 4,159,153 A * 6/1979 Yoshikawa ..... 312/333
4,182,539 A * 1/1980 Busch ..... 312/333
4,268,076 A * 5/1981 Itoi ..... 292/216
4,811,579 A * 3/1989 Lyons et al. ..... 70/85
5,386,636 A * 2/1995 Asano ..... 312/319.2
7,360,760 B2 * 4/2008 Lin ..... 271/162

FOREIGN PATENT DOCUMENTS

TW 307148 6/1997

* cited by examiner

*Primary Examiner*—Richard W Ridley
*Assistant Examiner*—Michael C McCullough
(74) *Attorney, Agent, or Firm*—Rosenberg Klein & Lee

(57) ABSTRACT

A cartridge includes a base, a tray and a latching element. The base has a boss. The tray is slidably mounted on the base. The base has a cartridge spring corresponding to the tray. The cartridge spring provides the tray a resilient force. The latching element has an eccentric hole that receives the boss of the base. A spring connects the latching element to the base so that the latching element can secure the tray to the base or release the tray from the base. It enhances the retaining of the tray so that even when the cartridge is impacted by an external force, the tray can still be kept closed. The cartridge of the invention provides advantages such as being highly stable, having fewer components, is easy to assemble, and costs less than prior art models.

7 Claims, 8 Drawing Sheets

CARTRIDGE

BACKGROUND OF THE PRESENT INVENTION

1. Field of the Invention

The present invention generally relates to a cartridge, and more particularly to a cartridge that does not tend to open when subjected to an external impact, and therefore has improved stability.

2. Description of the Related Art

A conventional cartridge, such as Taiwan Patent No. 307148 published on Jun. 1, 1997, discloses an automatic drawer that includes a tray and a handle. The tray has a track piece and a lid engaged with the track piece. The track piece has a track rail with a recess. A block comes to be embedded in the lid by the sliding movement of a resilient element which is mounted between the lid and the block. The handle has a swinging arm which has a sliding rod. By means of securely mounting the tray in a desk, the handle is securely mounted opposite to the drawer and extends into the tray. After the drawer is pushed, the sliding rod first moves along the track rails of the tray and is then positioned in the recess of the track rail so that the drawer can be opened. When the drawer is pushed again, the sliding rod moves out of the recess and withdraws from the track rail so that the drawer can be closed.

However, when the conventional drawer is pushed a first time, the tray cannot be held securely and can be accidentally opened. Specifically, when the drawer is subject to an external impact, the drawer tends to open, resulting in poor stability. Besides, the conventional drawer needs significant number of components, which translates to increased costs and labor.

SUMMARY OF THE INVENTION

One object of the invention is to provide a cartridge that can securely hold a tray even when the cartridge is impacted by an external force, and therefore has improved stability.

Another object of the invention is to provide a cartridge that has fewer components, is easy to assemble and therefore costs less.

In order to achieve the above and other objectives, the cartridge of the invention includes a base, a tray, and a latching element. The base has a boss. The tray is slidably mounted on the base. The base has a cartridge spring corresponding to the tray. The cartridge spring provides the tray a resilient force. The latching element has an eccentric hole that receives the boss of the base. A spring connects the latching element to the base so that the latching element can secure the tray to the base or release the tray from the base. It enhances the retaining of the tray so that even when the cartridge is impacted by an external force, the tray can still be kept in a closed status when not being used. The cartridge of the invention provides advantages such as high stability, fewer components, and fast and ease of assembly with an overall lower cost.

To provide a further understanding of the present invention, the following detailed description illustrates embodiments and examples of the present invention, this detailed description being provided only for illustration of the present invention.

DETAILED DESCRIPTION OF THE EMBODIMENTS

Figure 1:
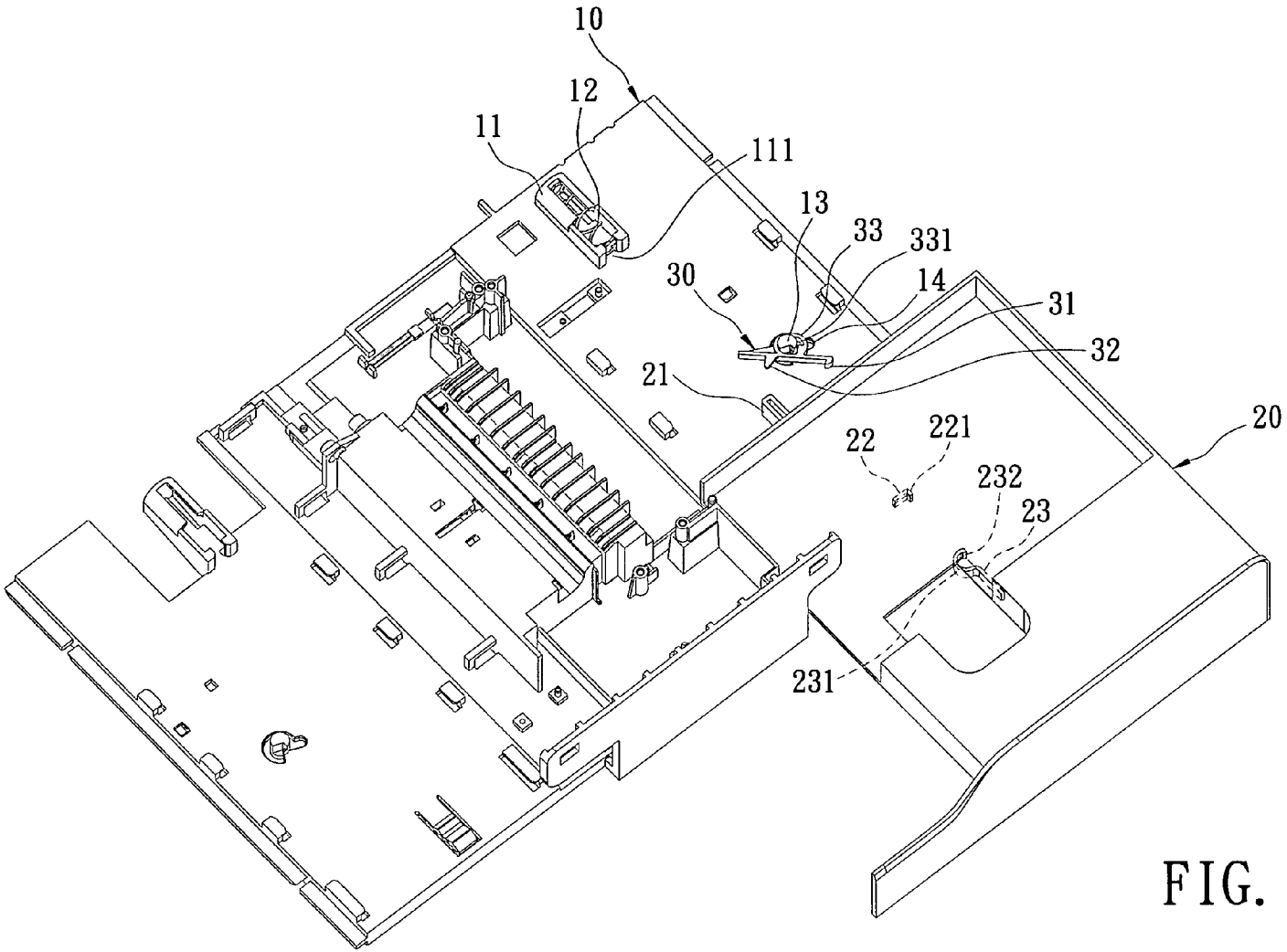
FIG. 1 is a perspective view of a cartridge according to one embodiment of the invention.
Figure 2A:
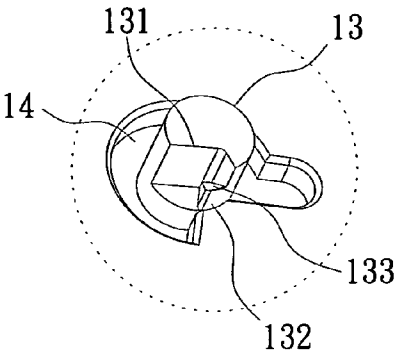
FIG. 2A is a detailed perspective view of a boss in a cartridge according to one embodiment of the invention.
Figure 2:
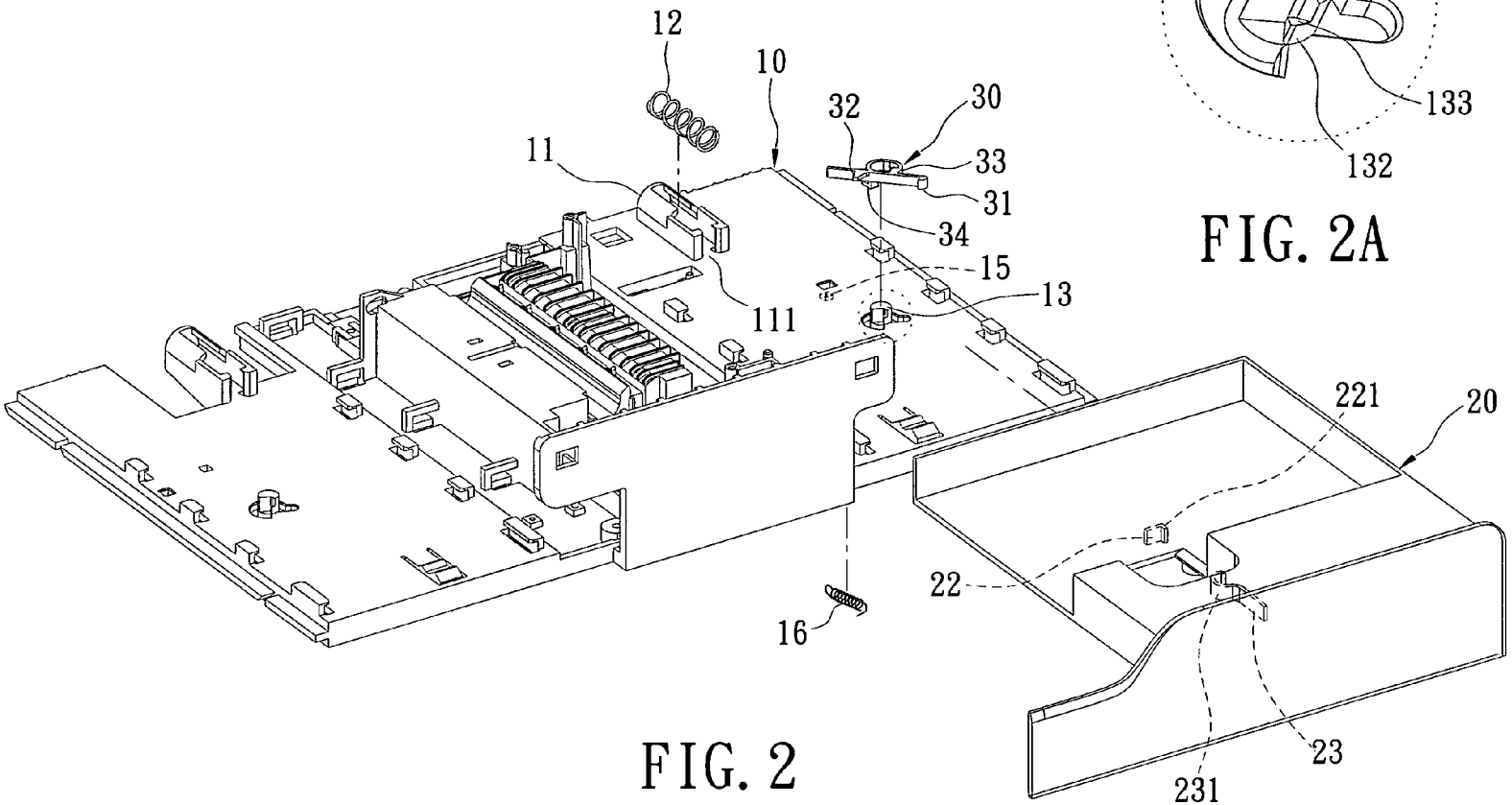
FIG. 2 is a perspective exploded view of a cartridge according to one embodiment of the invention.
Figure 3:
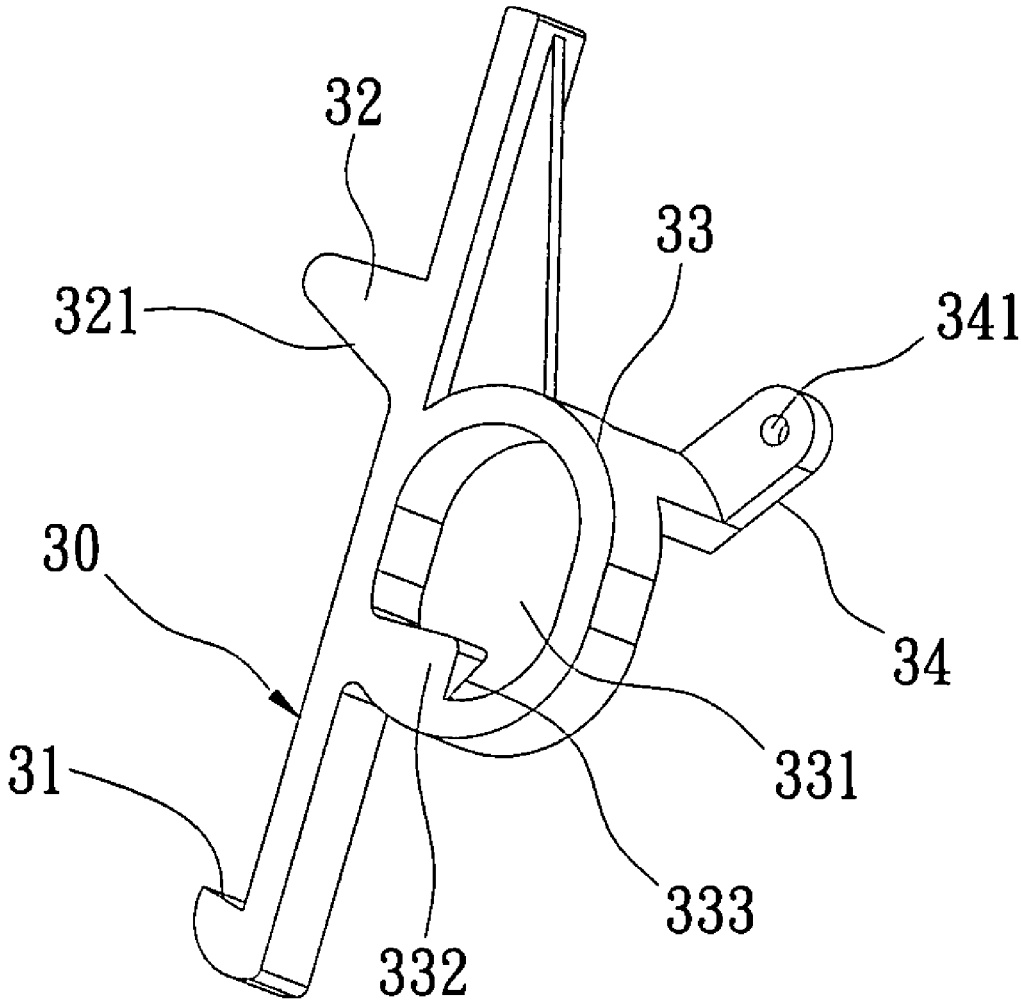
FIG. 3 is a perspective view of a latching element according to one embodiment of the invention.
Figure 4:
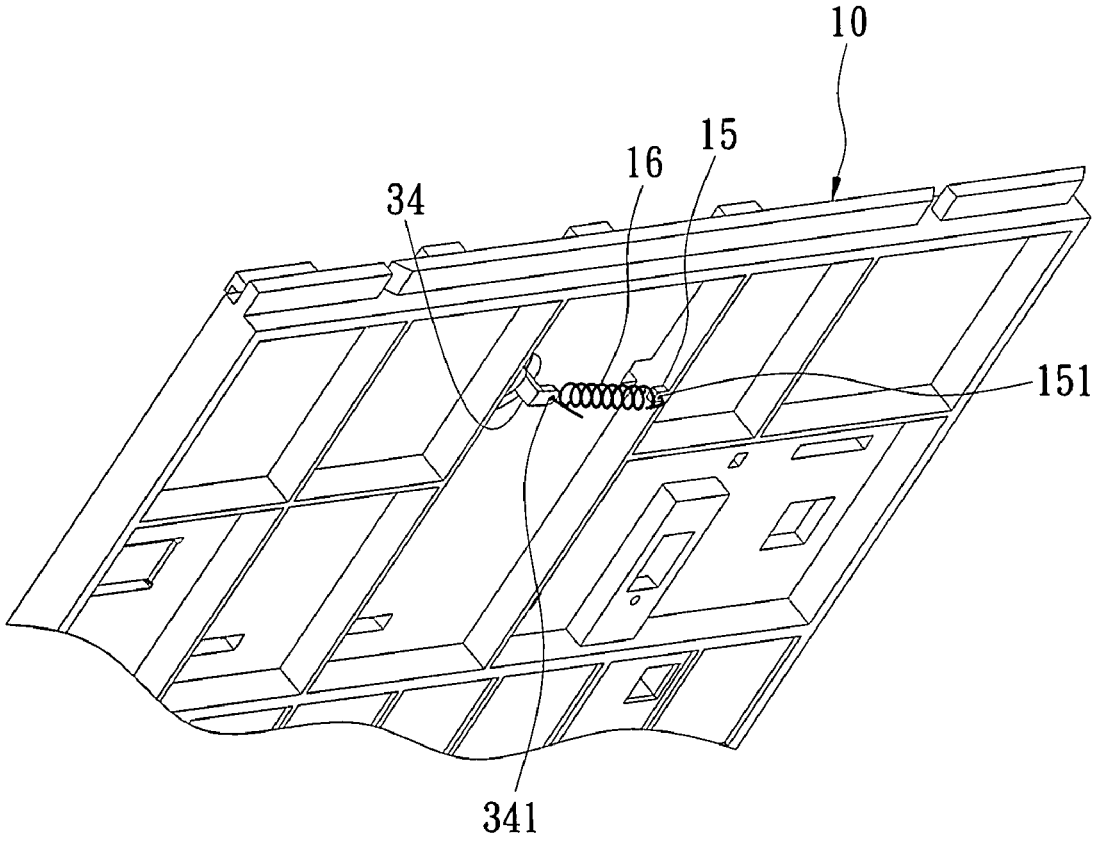
FIG. 4 is a perspective view of a latching element according to one embodiment of the invention taken from a different angle of view from FIG. 3.

Wherever possible in the following description, like reference numerals will refer to like elements and parts unless otherwise illustrated.

Referring to FIG. 1 through FIG. 4, the cartridge of the invention includes a base 10, a tray 20, and a latching element 30.

The base 10 can be a base provided with at least one tray 20, for example a work desk, a multi-functional processor, or a printer. In a case in which the base 10 is a multi-functional processor, a spring receiver 11 is formed inside the base 10 opposite to the tray 20. An opening 111 is formed at a front end of the spring receiver 11 to communicate with the interior of the spring receiver 11. The spring receiver 11 further has a cartridge spring 12.

The base 10 has a column-shaped boss protruded from the base 10. A slot is formed around the boss 13. On a top of the boss 13 is formed a recess 131 which has a protrusion 132 with a slanting top surface 133. The base 10 further has a retainer 15 having a round-profile fixing hole 151.

The tray 20 can be a drawer or a paper box. In one embodiment of the invention, the tray 20 is a paper box for holding paper. The tray 20 is disposed on the base 10 in a manner in which the tray 20 is able to slide back and forth along the base 10. A rib 21 protrudes from a rear of the tray 20 in a manner to correspond to the cartridge spring 12 so that the rib 21 is allowed to penetrate through the opening 111 of the spring receiver 11 to stretch into the spring receiver 11 and push against the cartridge spring 12. The cartridge spring 12 applies a forward force to the tray 20.

A first rib 22 and a second rib 23 are configured to protrude from a bottom of the tray 20, spaced away from each other at a distance. The first rib 22 is an L-shape and has a propping part 221 corresponding to the latching element 30. The second rib 23 has a bent part 231 extending along the first rib 22. The bent part 231 has a hook 232 protruding there from.

The latching element 30 has a free front end and a resilient hooking part 31 extending from the free front end. The latching element 30 further includes a stopper 32 and a ring part 33. The stopper 32 has a triangle shape and is connected to one side of the latching element 30. A guiding face 321 extends from the stopper 32 toward the resilient hooking part 31 at a certain angle from the direction of the resilient hooking part 31. The ring part 33 has a substantially ellipse shape, and is connected to the latching element 30 at the opposite side to the stopper 32. The ring part 33 has an eccentric hole 331 on an interior of which a flange 332 is formed. When the eccentric hole 331 receives the boss 13, the flange 332 comes to abut against the boss 13 so that the latching element 30 is pivotally connected to and rotated against base 10. A slanting face 333 is formed on a bottom of the flange 332 to correspond to the slanting top surface 133.

An L-shaped leg 34 extends from a bottom of the ring part 33. The leg 34 has a round-profile fixing hole 341. The leg 34 penetrates through the slot 14 and the fixing hole 341 to reach one end of the spring 16. The other end of the spring 16 connects to the fixing hole 151 of the retainer 15. The latching element 30 thereby fixes the tray 20 to the base 10 or the released tray 20 from the base 10.

Figure 5:
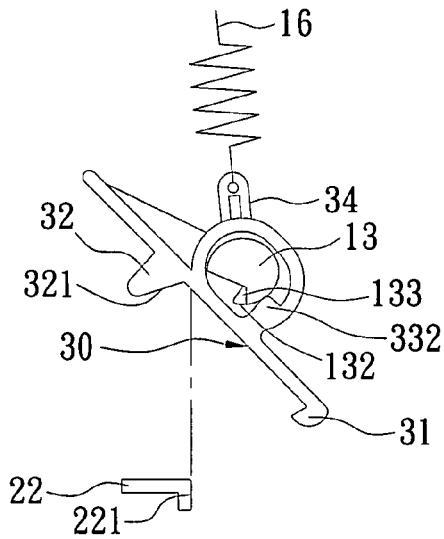
FIG. 5 is a schematic view of a first action of operation according to one embodiment of the invention.

Referring to FIG. 5, from a top view of the cartridge of the invention, the leg 34 of the latching element 30 connects to the spring 16. The spring 16 drives the latching element 30 to resiliently move, forcing the latching element 30 to move back and forth on one predetermined path.

Figure 6:
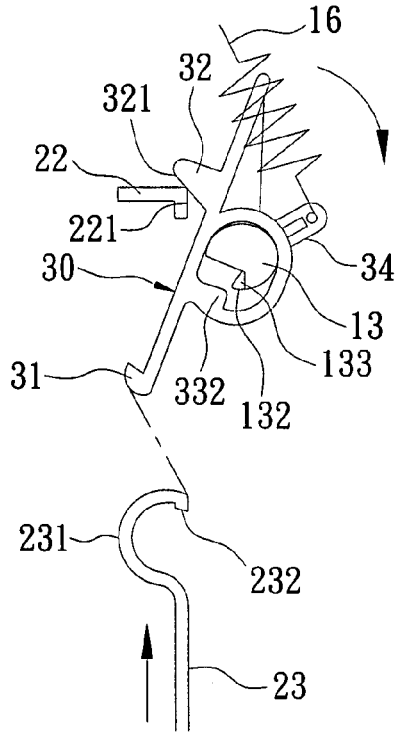
FIG. 6 is a schematic view of a second action of operation according to one embodiment of the invention.
Figure 7:
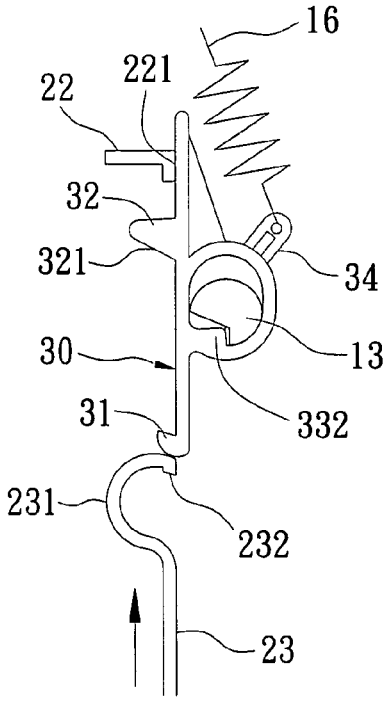
FIG. 7 is a schematic view of a third action of operation according to one embodiment of the invention.

Referring to FIG. 6 and FIG. 7, when the tray 20 is to be closed, the tray 20 is pushed toward a rear of the base 10 so that the first rib 22 of the tray 20 is driven to be against the guiding face 321 of the stopper of the latching element 30. The first rib 22 drives the latching 30 to move along the guiding face 321 so that the latching element 30 pivotally rotates against the boss 13 clockwise. After the flange 332 of the latching element 30 rotates over the protrusion 132 of the boss 13, the latching element 30 is drawn by the spring 16 so that the slanting face 333 of the flange 332 cooperates with the slanting top surface 133 of the protrusion 132 to engage the flange 332 with the protrusion 132. Thereby, the latching element 30 is securely propped onto the boss 13. After the first rib 22 passes by the stopper 32, the propping part 221 stops the latching element 30 from rotating.

Figure 8:
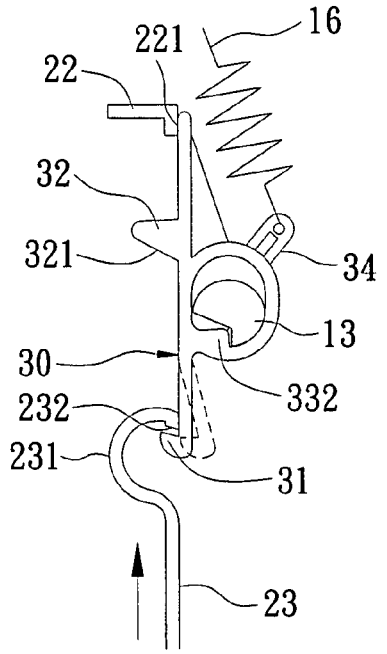
FIG. 8 is a schematic view of a fourth action of operation according to one embodiment of the invention.

Referring to FIG. 8, when the latching element 30 is securely propped by the boss 13 and stopped by the first rib 22, the tray 20 keeps sliding backward until the bent part 231 comes to contact the resilient hooking part 31 of the latching element 30 and makes the resilient hooking part 31 resiliently deformed. At this time, the hook 232 of the bent part 231 comes into one side of the latching element 30. Meanwhile, the rib 21 at the rear of the tray 20 comes into the spring receiver 11 through the opening 111 to reach against the cartridge spring 12.

Figure 9:
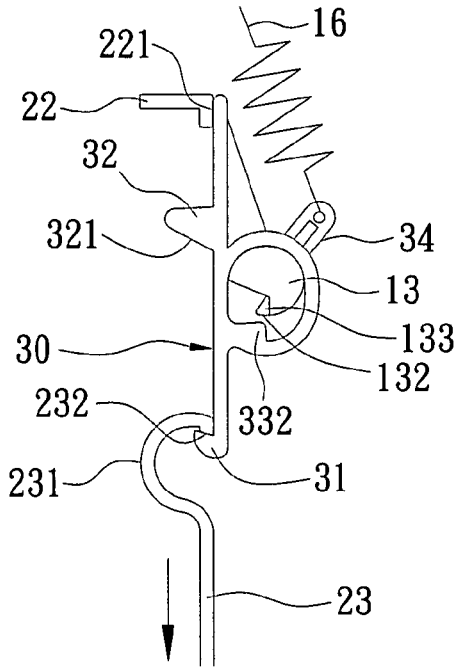
FIG. 9 is a schematic view of a fifth action of operation according to one embodiment of the invention.

Referring to FIG. 9, when the tray 20 is released, the rib 21 of the tray 20 is applied with a resilient force by the cartridge spring 12 so that the whole tray 20 is driven to move forward. At this moment, the latching element 30 lies against the propping part 221 of the first rib 22, and the second rib 23 drives the latching element 30 to move forward. Thereby, the flange 332 of the latching element 30 departs from the protrusion 132 of the boss 13, and the hook 232 of the bent part 231 comes to engage with the resilient hooking part 31 of the latching element 30. The popping part 221 of the first rib 22 remains stopped by one side of the latching element 30. Thereby, the latching element 30 forces the tray 20 to be secured inside the base 10.

Figure 10:
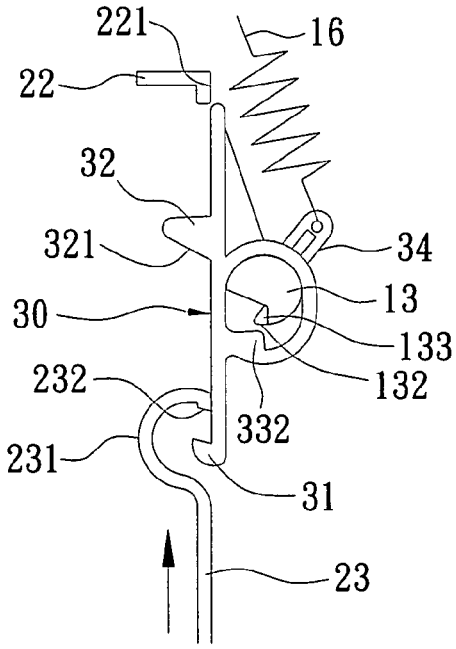
FIG. 10 is a schematic view of a sixth action of operation according to one embodiment of the invention.
Figure 11:
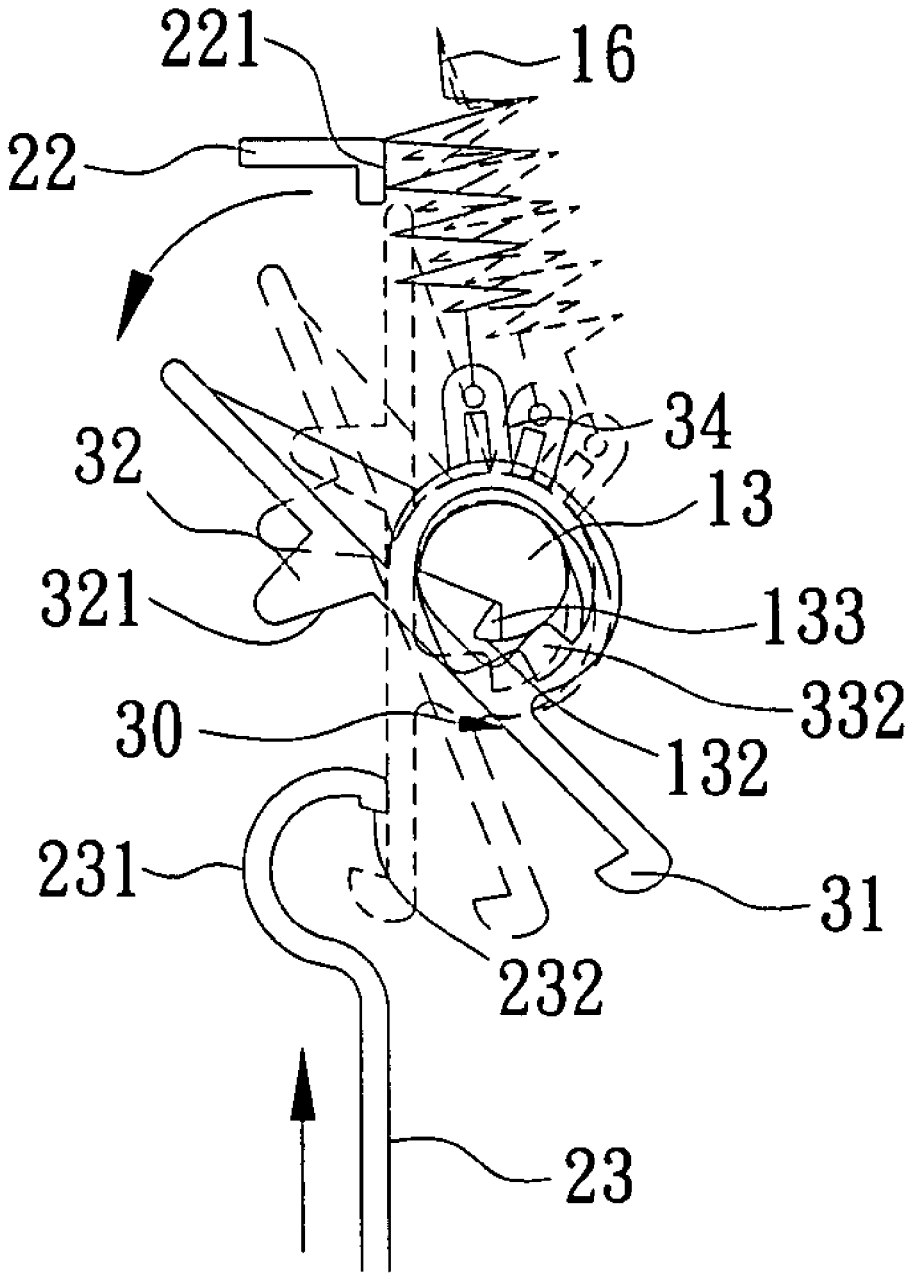
FIG. 11 is a schematic view of a seventh action of operation according to one embodiment of the invention.

Referring to FIG. 10 and FIG. 11, when the tray 20 is to be withdrawn from the cartridge, the tray 20 is pushed again to slide backward and thus to press the cartridge spring 12. When the first rib 2 of the tray 20 is back to the rear of the latching element 30 and thus releases the latching element 30, the latching element 30 is drawn by the spring 16 to rotate counterclockwise. The resilient hooking part 31 of the latching element 30 is released from the hook 232 of the bent part 231 and thereby the tray 20 is released. The latching element 30 which is drawn by the spring 16 returns to its original position as shown in FIG. 5. At this moment, the cartridge spring 12 at the rear of the tray 20 applies a resilient force to the tray 20 to force the tray 20 to move forward a certain distance. In this way, the base 10 is driven to open.

Thereafter, the tray 20 can be drawn out of the base 10. When the tray 20 is drawn out, the first rib 22 is pushed to be against the rear of the stopper 32 to drive the latching element 30 to rotate counterclockwise, which allows the tray 20 to be easily drawn out. After the first rib 33 completely passes the latching element 30, the latching element 30 is driven to rotate clockwise by the spring 16 to return to its original position as shown in FIG. 5.

Therefore, the cartridge of the invention can be closed when the tray 20 is pressed at first time, and opened when pressed a second time. The cooperation of the latching element 30 with the ribs 22, 23 of the tray 20 offers the releasing and securing of the tray 20. The spring 16 provides a resilient force to the latching element 30 to force the latching element 30 to move on a predetermined path. When the tray 20 is closed, the resilient hooking part 31 of the latching element 30 engages with the hook 232 of the second rib 23, and the propping part 221 of the tray 20 is stopped by one side of the latching element 30. This enhances the retaining of the tray 20 so that even when the cartridge is impacted by an external force, the tray 20 can still be kept in a closed status. The cartridge of the invention provides advantages such as being highly stable, has fewer components, and is fast and easy to assembly.

It should be apparent to those skilled in the art that the above description is only illustrative of specific embodiments and examples of the present invention. The present invention should therefore cover various modifications and variations made to the herein-described structure and operations of the present invention, provided they fall within the scope of the present invention as defined in the following appended claims.

What is claimed is:

1. A cartridge, comprising:

a base having a boss and a cartridge spring;

a tray slidably mounted on the base and corresponding to the cartridge spring in a manner in which the cartridge spring offers the tray a resilient force; and a latching element having an eccentric hole that receives the boss of the base, wherein a spring connects the latching element to the base so that the latching element can secure the tray to the base or release the tray from the base, the latching element including a stopper and a ring part, the stopper being disposed on one side of the latching element, a guiding face being extended from the stopper toward a hookin part at a certain angle from the direction of the hooking part, the ring part being disposed on a side of the latching element opposite to the side on which the stopper is disposed, and the ring part having the eccentric hole formed therein, a leg extends from a bottom of the ring part, a slot being formed around the boss, the leg penetrating through the slot to reach at one end of the spring, the base further having a retainer that connects to the other end of the spring.

2. The cartridge of claim 1, wherein the base has a spring receiver at a front end upon which an opening is formed, the cartridge spring is mounted inside the spring receiver, a rib protrudes from a rear of the tray so that the rib of the tray comes to abut against the cartridge spring through the opening.

3. The cartridge of claim 1, wherein the boss has a protrusion, and the latching element has a flange which can engage with the protrusion of the boss.

4. The cartridge of claim 3, wherein the protrusion has a slanting top surface, and the flange has a slanting face which corresponds to the slanting top surface.

5. The cartridge of claim 1, wherein a first rib and a second rib are configured to protrude from a bottom of the tray, the first rib having a propping part which can abut against one side of the latching element, the second rib being spaced apart from the first rib at a distance, and the second rib having a hook, the latching element having the hooking part which corresponds to the hook and can engage with the hook.

6. The cartridge of claim 5, wherein the hooking part is resilient.

7. The cartridge of claim 1, wherein the latching element is driven to move on a path.

* * * * *